United States Patent [19]

Ishida

[11] Patent Number: 4,642,892

[45] Date of Patent: Feb. 17, 1987

[54] T-SHAPED RAZOR

[75] Inventor: Minoru Ishida, Gifu, Japan

[73] Assignee: Feather Safety Razor Co., Ltd., Seki, Japan

[21] Appl. No.: 678,438

[22] Filed: Dec. 5, 1984

[30] Foreign Application Priority Data

| | | | |
|---|---|---|---|
| Dec. 19, 1983 | [JP] | Japan | 58-195235[U] |
| Dec. 22, 1983 | [JP] | Japan | 58-197350[U] |
| Jul. 5, 1984 | [JP] | Japan | 59-101778[U] |
| Oct. 5, 1984 | [JP] | Japan | 59-151465[U] |

[51] Int. Cl.[4] ..... B26B 21/38

[52] U.S. Cl. ..... 30/44; 30/45; 30/48; 30/50

[58] Field of Search ..... 30/42, 44, 45, 48, 50, 30/DIG. 1, 32, 46

[56] References Cited

U.S. PATENT DOCUMENTS

| | | | |
|---|---|---|---|
| 2,040,683 | 5/1936 | Biniek | 30/45 |
| 2,042,293 | 5/1936 | Biniek | 30/45 |
| 2,258,608 | 10/1941 | Harshberger | 30/44 |
| 3,964,159 | 6/1976 | Ferraro | 30/50 |
| 4,128,937 | 12/1978 | Adorney | 30/48 |
| 4,335,509 | 6/1982 | Smith | 30/48 |

FOREIGN PATENT DOCUMENTS

| | | |
|---|---|---|
| 152645 | 11/1979 | Japan . |
| 1065588 | 4/1967 | United Kingdom . |

*Primary Examiner*—Frank T. Yost
*Assistant Examiner*—Hien H. Phan
*Attorney, Agent, or Firm*—Jordan and Hamburg

[57] ABSTRACT

Herein disclosed is a T-shaped razor comprising a holder, and a head attached to the holder and having at least one blade. The head is supported such that it can move in directions which are inclined generally in the longitudinal direction of the holder with respect to a plane longitudinal in the extending direction of the edge of the blade. Further comprised is drive means which is disposed in the holder for reciprocating the head obliquely.

11 Claims, 40 Drawing Figures

T-SHAPED RAZOR

BACKGROUND OF THE INVENTION

1. Field of the Invention

The present invention relates to a T-shaped razor capable of reciprocating a blade assembly.

2. Description of the Prior Art

In the prior art, the T-shaped razor cuts or clips hair from the body by having its blade assembly pressed against the surface of the skin and moved back and forth at a right angle with respect to its blade edge. As a result, the shaving action is to glide in one direction on the undulations of the skin surface, thus making it difficult to cut off the hair including its root by the single action. This results in much hair left uncut. Moreover, the shaving action is conducted by the so-called "pressed cutting", in which the blade edge is pressed to cut the hair, so that it is not enjoyable.

SUMMARY OF THE INVENTION

An object of the present invention is to provide a T-shaped razor which allows the user to enjoy a better cutting quality by enabling the hair shaving action to be accompanied by the so-called "pulled cutting".

Another object of the present invention is to provide a T-shaped razor which is enabled not only to improve the shaving quality but also to eliminate a danger of cutting the skin in the shaving action by specifying the obliquely running direction of the blade assembly in relation to the hair cutting tangential plane.

Still another object of the present invention is to provide a T-shaped razor which is simple in construction and requires not only less precision in size but also simple technique for assembly and disassembly in manufacturing the same.

Other objects of the present invention will become apparent from the following description taken in conjunction with the embodiments and are clearly specified in the accompanying claims. Moreover, those skilled in the art will find out many advantages left untouched herein if they put the present invention into practice.

BRIEF DESCRIPTION OF THE DRAWINGS

FIG. 13 is a sectional view showing a razor;

FIG. 14 is a partially enlarged sectional view showing the razor;

FIG. 15 is an exploded perspective view showing a stationary guide member and a movable guide member;

FIG. 16 is a perspective view showing the assembly of the parts of FIG. 15; and FIG. 17 is a top plan view showing the razor.

FIG. 18 is an exploded perspective view showing a stationary guide member and a movable guide member;

FIG. 19 is a perspective view showing the assembly of the parts of FIG. 18; and FIG. 20 is a back elevation showing a portion of the razor.

FIG. 21 is a partially broken front elevation showing a razor;

FIG. 22 is a side elevation of the same;

FIG. 23 is a back elevation of the same;

FIG. 24 is a top plan view showing a portion of the same;

FIG. 25 is a sectional view showing a cartridge mounting portion; and

FIG. 26 is a partially broken top plan view corresponding to FIG. 24.

FIG. 30 is a partially cut-away side elevation showing a T-shaped razor;

FIG. 31 is a partially cut-away back elevation showing the same;

FIG. 32 is a perspective view showing the T-shaped razor with a spare blade cartridge being removed;

FIG. 33 is a partially enlarged perspective view showing a coacting lever; and FIG. 34 is a partially enlarged sectional view showing the reciprocating action of a head.

DETAILED DESCRIPTION OF THE PREFERRED EMBODIMENTS

Figure 1:
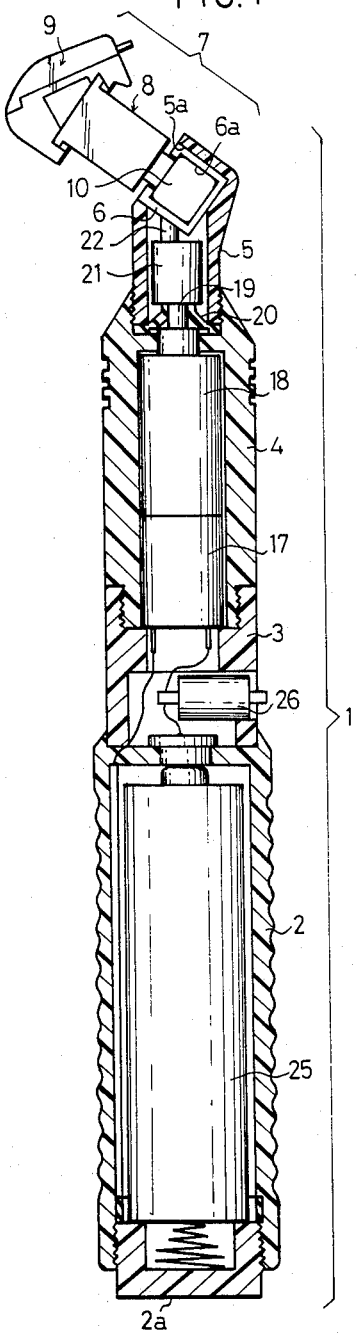
FIG. 1 is a sectional view showing a T-shaped razor according to a first embodiment of the present invention.
Figure 2:
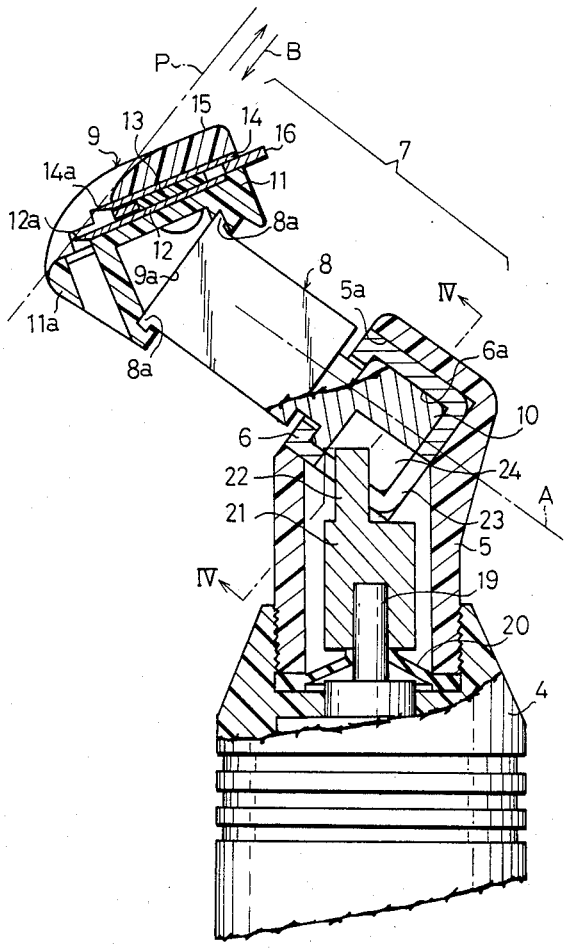
FIG. 2 is a partially enlarged sectional view showing a head portion of the T-shaped razor of FIG. 1.
Figure 3:
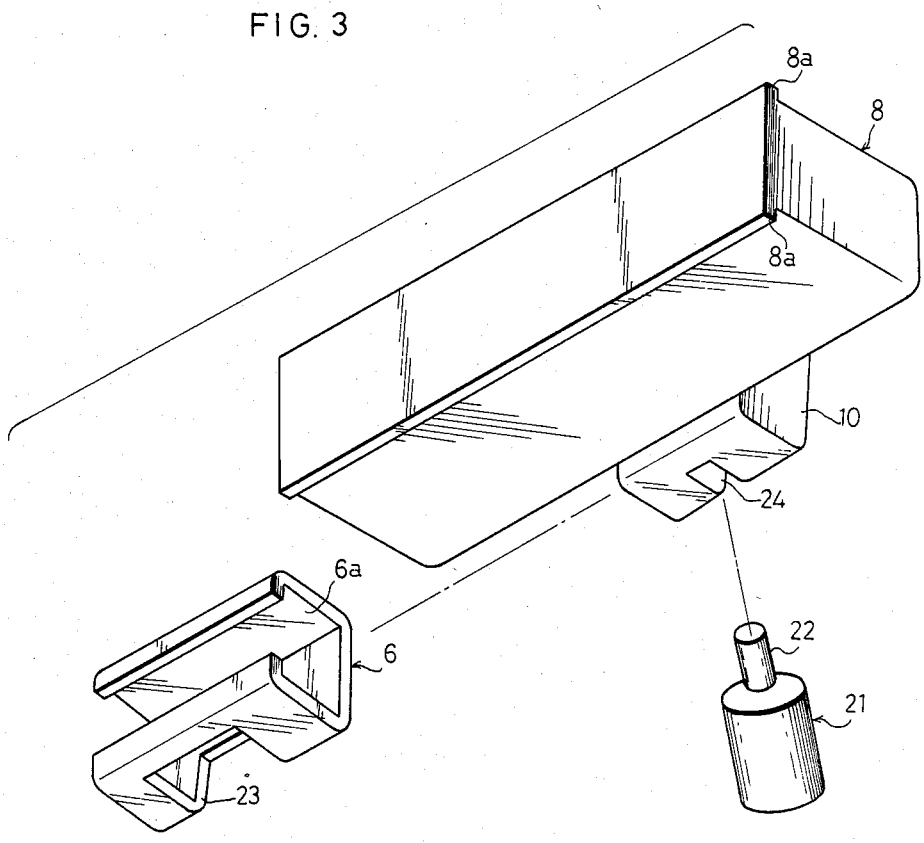
FIG. 3 is a partially exploded perspective view showing a supporting member of the head and a rail portion and a rotary member at the side of a holder.
Figure 4:
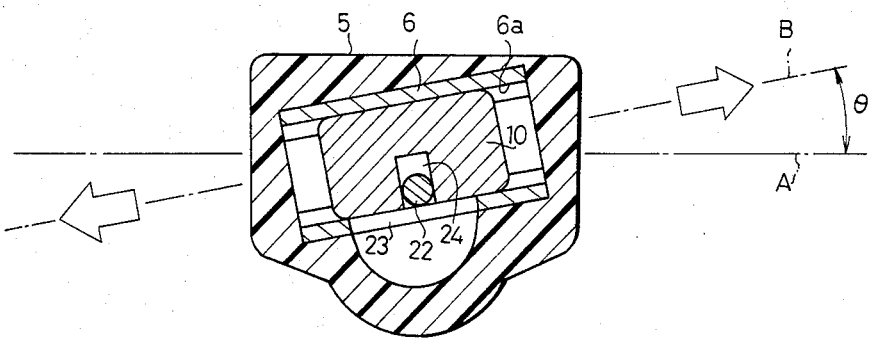
FIG. 4 is a section taken along line IV—IV of FIG. 2.

The present invention will be described in the following in connection with a first embodiment thereof with reference to the accompanying drawings. As shown in FIG. 1, a holder 1 is constructed of a dry cell barrel 2, a switch casing 3 fixed on the upper end portion of the dry cell barrel 2, a motor casing 4 screwed in the upper end portion of the switch casing 3, and a rail mounting portion 5 screwed in the upper end portion of the motor casing 4. As shown in FIG. 2, the rail mounting portion 5 is formed at the upper end portion of its front face with an opening 5*a* which is opened obliquely upward. In the rail mounting portion 5, there is fitted a rail portion 6 which has a U-shaped section opened to face the opening 5*a*, as shown in FIG. 3. A guide groove 6*a* formed in that rail portion 6 is extended in a direction B (at an angle of inclination $\theta$ of about 10 degrees), which is inclined upward and downward with respect to a plane A extending transversely, as shown in FIG. 4.

As shown in FIG. 2, a head 7 acting as a blade mounting portion is constructed of a supporting member 8 shown in FIG. 3, and a spare blade cartridge 9 which is removably mounted through its fitting groove 9*a* on a pair of guide rails 8*a* formed on the front end portion of the supporting member 8. A guide block 10 formed at the back of the supporting member 8 is fitted in the guide groove 6*a* of the aforementioned rail portion 6. In the spare blade cartridge 9, a lower blade 12, a spacer 13 and an upper blade 14 are overlaid consecutively on a blade bed 11. This overlaid assembly is clamped between a head plate 15 placed on the upper blade 14 and the aforementioned blade bed 11, and a scraper 16 for scraping cut hair leavings is sandwiched between the lower blade 12 and the upper blade 14. These upper and lower blades 14 and 12 have their edges 14*a* and 12*a* protruding slightly from a shaving tangential plane P which joins the crest of the head plate 15 and a guard 11*a* at the front end of the blade bed 11. Moreover, the head 7 is supported in its entirety on the rail portion 6 such that it can reciprocate in the directions B which are inclined perpendicularly with respect to the plane A extending perpendicularly to a plane passing through the edges 12*a* and 14*a* of the blades 12 and 14 of the spare blade cartridge 9, and are generally in parallel with the aforementioned shaving tangential plane P.

As shown in FIG. 1, a motor 17 and a reduction gear head 18 are fitted in the aforementioned motor barrel 4. As better seen from FIG. 2, the reduction gear head 18 has its shaft 19 protruding through a water-proofing shield 20 into the aforementioned rail mounting portion 15. On the shaft 19, there is fixed a rotary member 21 which is equipped with an eccentric shaft 22. The leading end portion of this eccentric shaft 22 is engaged with an engagement recess 24, which is formed at the back of the guide block 10 of the aforementioned supporting member 8, through a notched portion 23 which is formed at the back of the aforementioned rail portion 6.

As shown in FIG. 1, a dry cell 25 is fitted in the aforementioned dry cell barrel 2 by removing a cover 2*a* which is screwed in the lower end portion thereof. The dry cell 25 is electrically connected with the aforementioned motor 17 through a switch 26 which is housed in the aforementioned switch case 26. Incidentally, the motor 17, the reduction gear head 18 and the rotary member 21 constitute together a drive mechanism.

Figure 5:
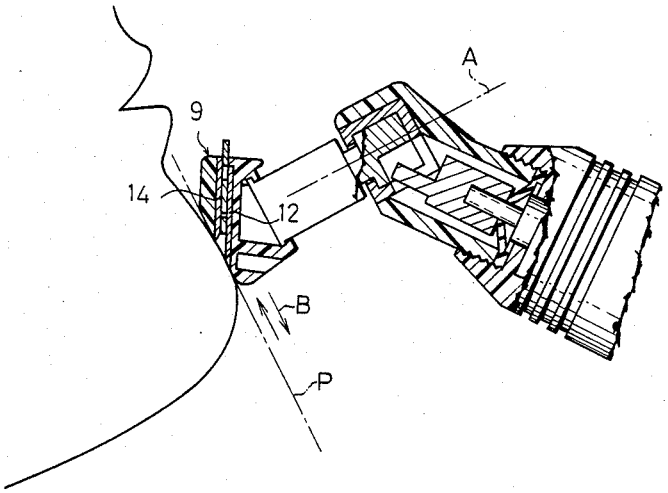
FIGS. 5 and 6 are operation explaining views showing the reciprocating directions of a blade assembly with respect to a shaving tangential plane.
Figure 6:
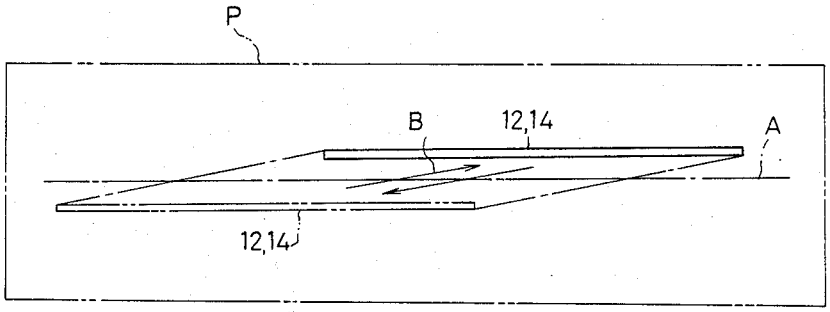

Now, when the spare blade cartridge 9 is pressed against the surface of the skin, as shown in FIG. 5, and then the switch 26 is turned on to turn the motor 17, the rotary member 21 is rotated through the speed-reduced rotary shaft 19 to rock the eccentric shaft 22. By these rocking motions, moreover, the guide block 10 of the supporting member 8 is reciprocated along the guide groove 6*a* of the rail portion, as shown in FIG. 4, so that the blades 12 and 14 are reciprocated in the aforementioned inclined directions B, as shown in FIGS. 5 and 6. In the present embodiment: the obliquely running direction $\theta$ is about 10 degrees; the reciprocating stroke is about 2 mm; and the frequency of reciprocations is about 2,500 per minute. Incidentally, the obliquely running angle, the reciprocating stroke and the reciprocating frequency can be set within the ranges of 1 to 80 degrees, 1 to 10 and more mm, and 100 to 5,000, respectively. In case the reciprocating stroke is made large, on the other hand, it is necessary for safety to reduce the reciprocating frequency.

In the razor of the prior art, as the blade assembly glides past downward, the hair is pushed down so that the blade edge bites into the root of the hair thereby to undergo the so-called "pushed cutting". However, it is customary to leave the hair uncut on the skin surface. This makes it necessary to try to cut the hair at one skin portion many times. Therefore, there is conceived a razor which has its performance improved better by finely vibrating the blade assembly to effect the pulled cutting.

Figure 7:
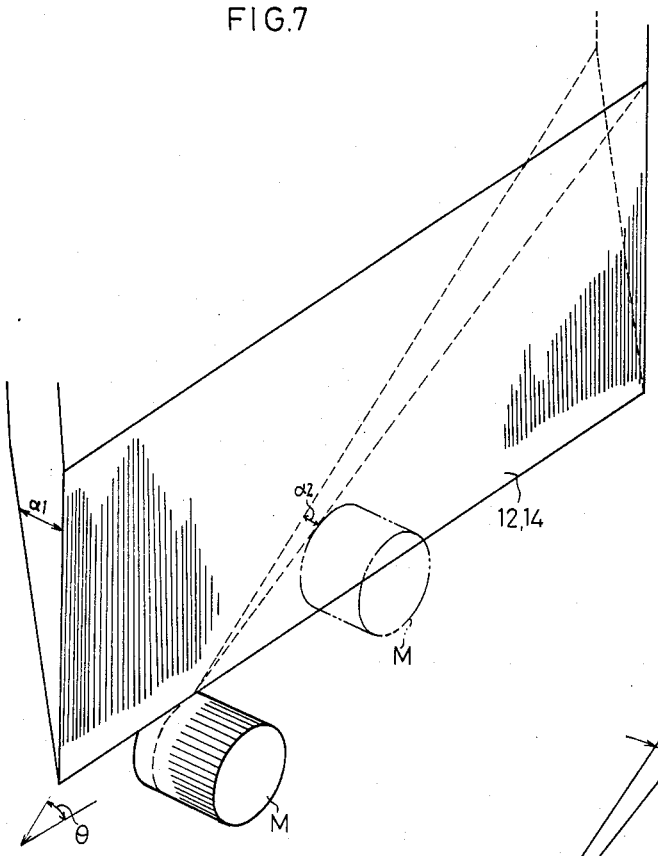
FIG. 7 is a partially sectional view showing the pulled cutting action by the blade assembly.
Figure 8:
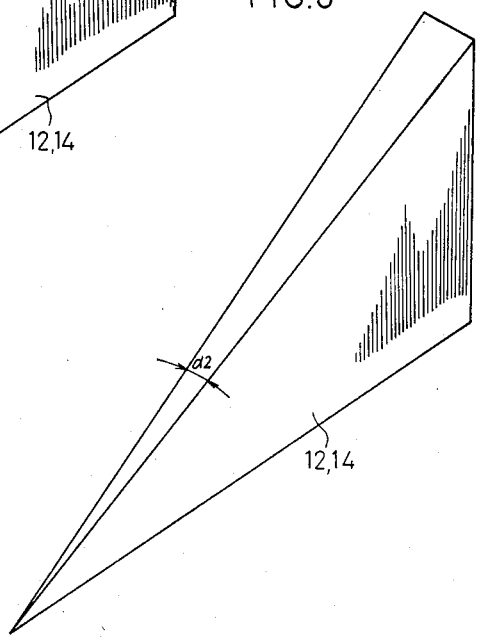
FIG. 8 is a sectional view of the blade assembly and shows the contacting locus between hair and the assembly.

Incidentally, for this pulled cutting of this invention, when hair M is to be cut by the blades 12 and 14, as shown in FIG. 7, the section of these blades 12 and 14 moving along the direction B is shown in FIG. 8. Namely, the blades 12 and 14 move relative to the hair M at an angle $\alpha 2$. Moreover, the edge angle $\alpha 2$ of the section becomes smaller at all times than the edge angle $\alpha 1$ for the pushed cutting shown in FIG. 7. Namely, when comparing the pulled cutting of the present invention and the pushed cutting, even if the same blade is used, cutting edge angle of the pulled cutting is sharper than that of the pushed cutting. As a result, the edge angle $\alpha 2$ by the pulled cutting is further sharpened to bring about a high effect.

Figure 9:
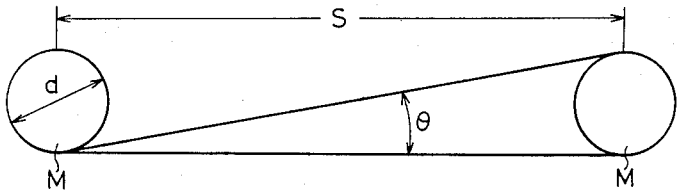
FIG. 9 is an operation explaining diagram showing the relationship among a reciprocating stroke, an obliquely running angle and the sectional diameter of the hair.

Usually, the section of the hair M takes a shape of an oval having a shorter diameter of 0.125 mm and a longer diameter of 0.17 mm. Therefore, it is assumed that the section of the hair M is shaped into a circle having a diameter d, as shown in FIG. 9. Then, the reciprocating stroke S necessary for the obliquely running angle $\theta$ is expressed by $(d \times 1/\tan\theta)$. If $d=0.17$ mm and $\theta=10$ degrees are substituted into the above equation, $S=0.964$ mm. In other words, the reciprocating stroke S has to be at least about 1 mm so that the hair M may be pulled and cut completely under the above condition. Incidentally, the stroke S is reduced if the aforementioned obliquely running angle $\theta$ is set larger than 10 degrees. An excessively large value of the angle $\theta$ is not desirable for safety. If the angle $\theta$ is set smaller than the value of 10 degrees, on the contrary, the stroke S has to be enlarged. However, an excessively small value of the angle $\theta$ will degrade the shaving quality.

By the reasoning thus far made, it is possible to expect a considerable effect but not a sufficient pulled cutting effect if the blade assembly is finely vibrated, as in the prior art.

In the present embodiment, however, since the blades 12 and 14 are given the sufficient reciprocating stroke S, the pulled cutting can be ensured better in addition to the pushed cutting to improve the shaving quality better than that of the case of the fine vibrations, even if a variety of conditions are imagined. Moreover, it is considered necessary by the aforementioned reasoning that the reciprocating stroke S be at least about 1 mm.

Since the blades 12 and 14 are reciprocated in the directions B which are generally in parallel with the shaving tangential plane P joining the head plate 15 and the guard 11*a* of the blade bed 11, moreover, they are prevented from biting excessively deeply into the skin surface by the reciprocating motions so that the safety is improved far better.

Still moreover, since the guide groove 6*a* of the rail portion 6 is extended in the directions B which are inclined perpendicularly with respect to the plane A extending in the direction of the edges 12*a* and 14*a* of the blades 12 and 14 of the spare blade cartridge 9, i.e., in the transverse directions and are generally in parallel with the aforementioned shaving tangential plane, the reciprocating motions in the transverse and vertical directions are simultaneously given to the blades 12 and 14 even by the simple construction. The reciprocating directions of these blades 12 and 14 need not always be in parallel with the shaving tangential plane P, unless the blades 12 and 14 protrude during their reciprocations from the shaving tangential plane P toward the skin surface, but may be directed slightly backward (i.e., away from the skin surface) with reference to the shaving tangential plane P.

Figure 10:
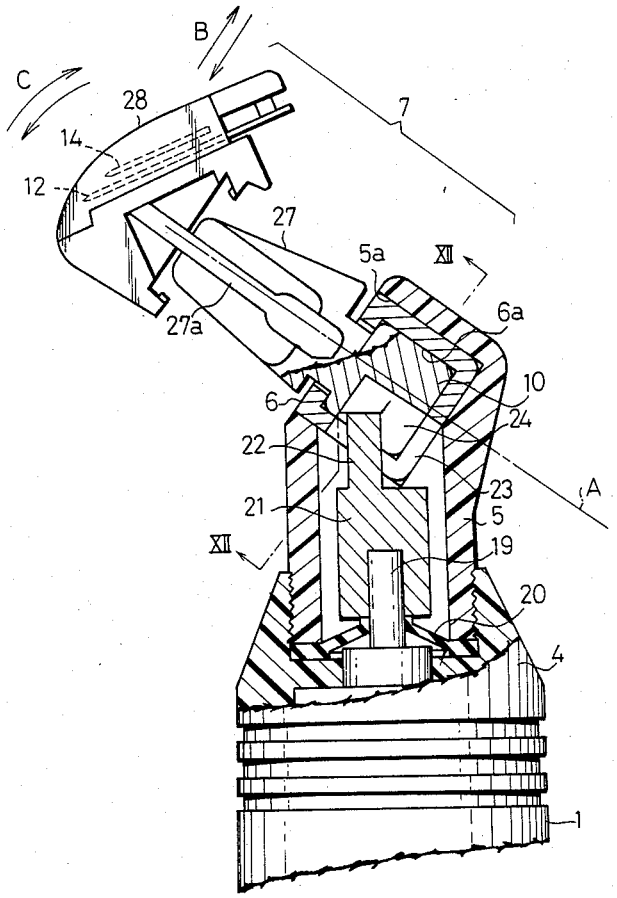
FIG. 10 is a partially sectional view showing the head portion of a T-shaped razor according to another example of the first embodiment of the present invention.
Figure 11:
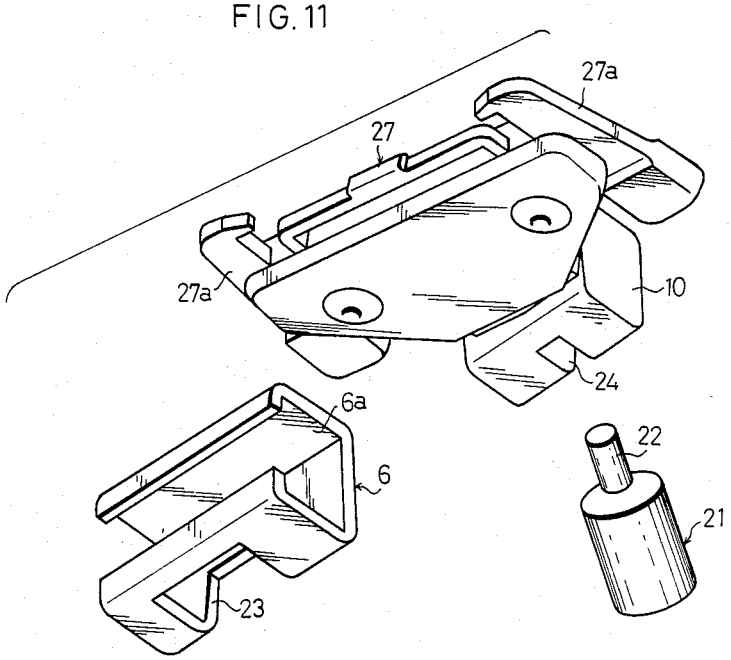
FIG. 11 is a partially exploded perspective view showing the supporting member the head and the rail portion and the rotary member at the side of the holder.
Figure 12:
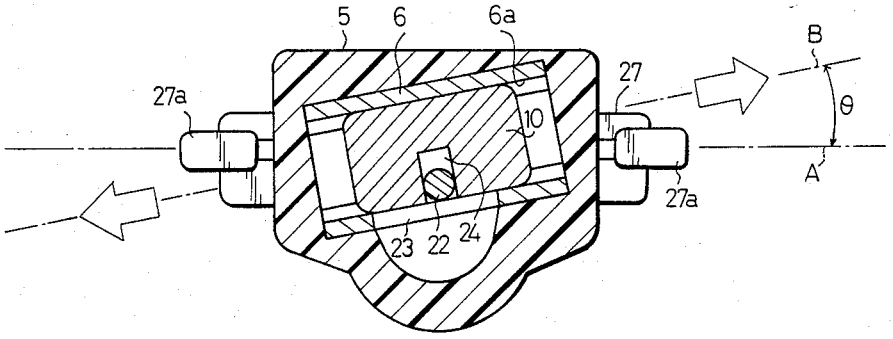
FIG. 12 is a section taken along line XII—XII of FIG. 10.

As shown in FIGS. 10 to 12, moreover, a spare blade cartridge 28 of the head 7 may be supported to be inclined back and forth, as indicated at C, with respect to two arms 27*a* of a supporting member 27.

Incidentally, the present invention can be either modified such that only the blade mounting portion supporting the blades 12 and 14 is reciprocated in the head 7 fixed on the holder 1 or applied to a safety razor having a single blade.

Figure 14:
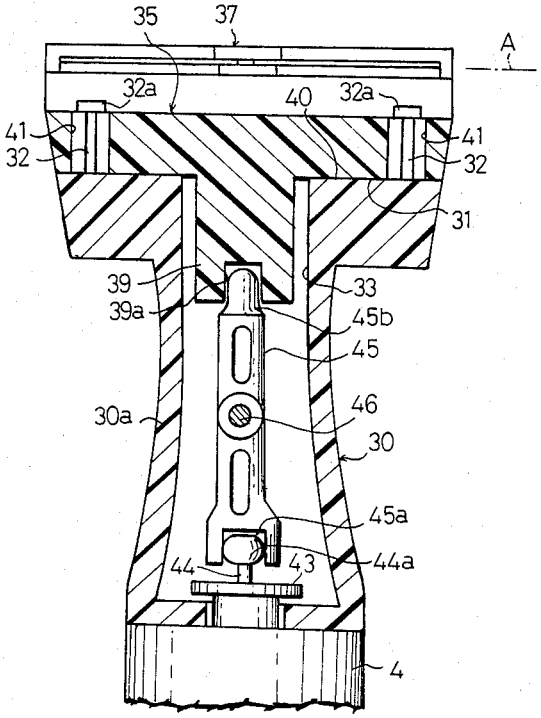
Figure 15:
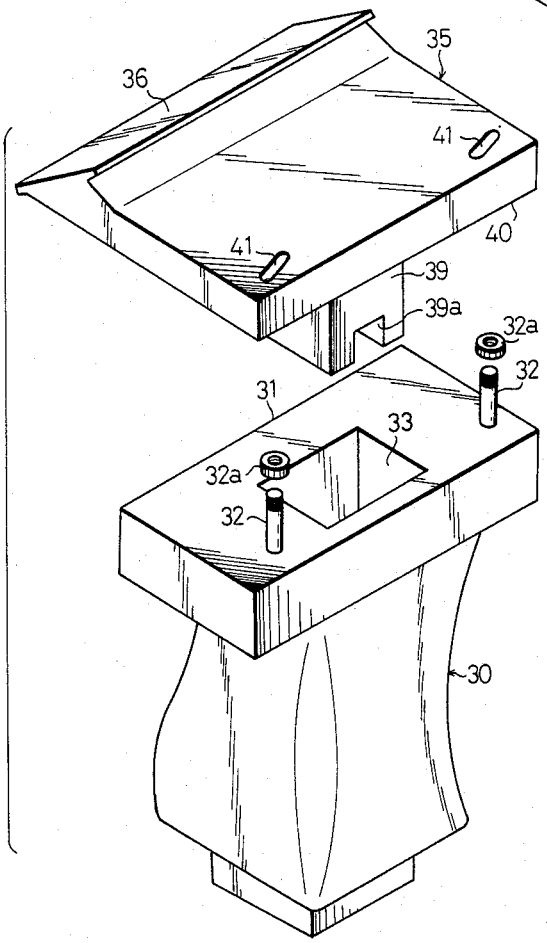

Next, a second embodiment of the present invention will be described with reference to FIGS. 13 to 17, wherein differences of the second embodiment from the first embodiment are particularly explained. Indicated at reference numeral 30 is a stationary guide member which is fitted in the upper end portion of the motor barrel 4 and which is formed on its top with a supporting face 31, as shown in FIG. 15. This supporting face 31 is formed at both its right and left side portions with a pair of guide protrusions 32 which protrude upward. The supporting face 31 is formed at its central portion with such a mouth 33 as has communication with an accommodating barrel 30*a* of the stationary guide member 30.

Figure 13:
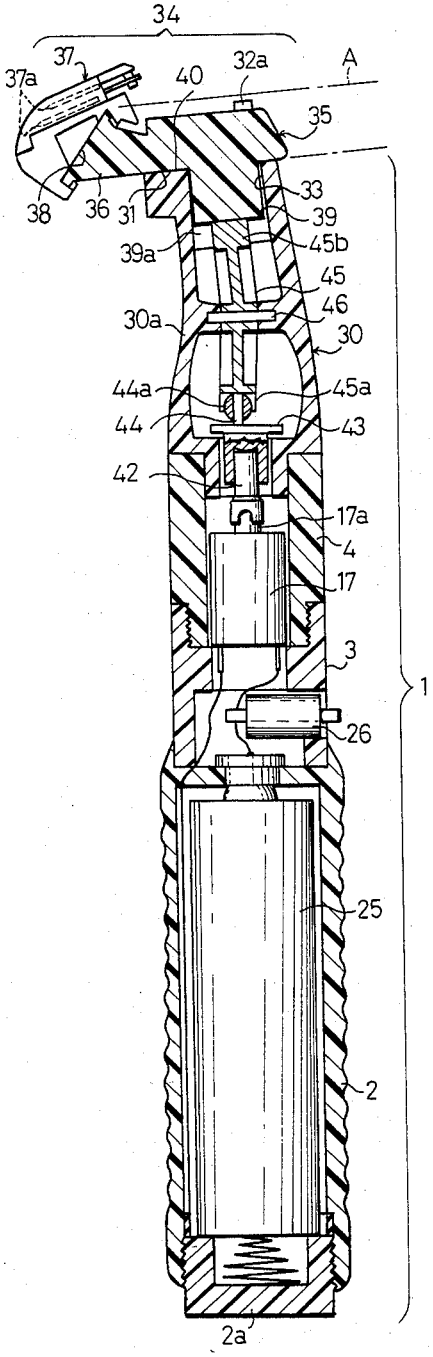
In FIGS. 13 to 17 showing a second embodiment of the present invention.
Figure 16:
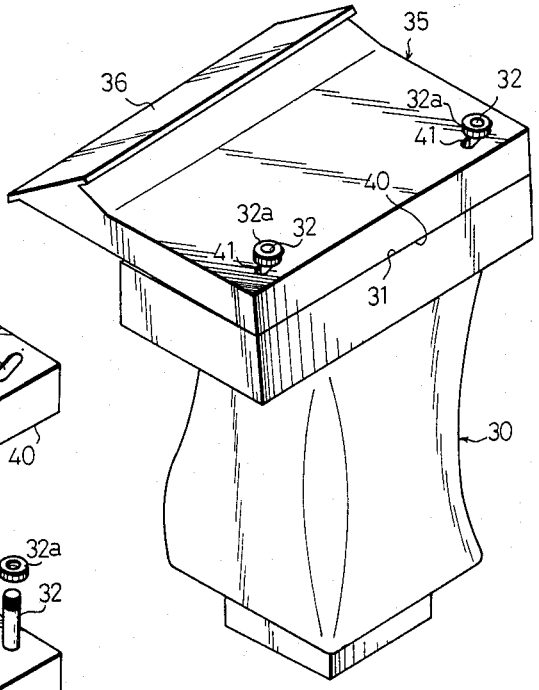
Figure 17:
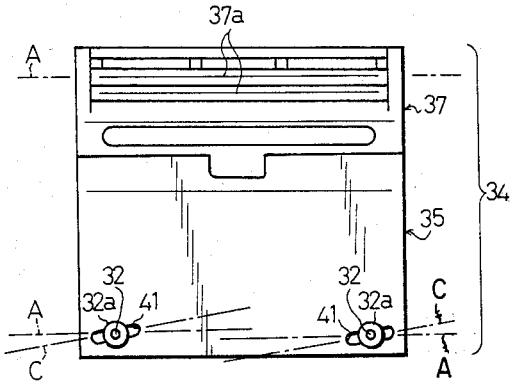

As shown in FIG. 13, a head 34 acting as the blade mounting portion is constructed of a movable guide member 35, and a spare blade cartridge 37 which is removably supported through its fitting groove 38 on a rail portion 36 formed on the front end portion of that movable guide member 35. As better seen from FIG. 15, this movable guide member 35 is formed at its lower portion with a leg 39, which is to be fitted in the mouth 33 of the aforementioned stationary guide member 30, and on its bottom with a supporting face 40 which is, after insertion of the leg 39 into the mouth 33, to be placed upon the supporting face 31 of the stationary guide member 30, as shown in FIG. 16. These supporting faces 31 and 40 extend, as shown in FIGS. 13 and 14, in parallel with the plane A, wherein one of an edge of a blade 37*a* of the aforementioned spare blade cartridge 37, lies. As shown in FIGS. 15 and 17, moreover, the movable guide member 35 is formed at both its right and left side portions with a pair of guide holes 41 which extend in the direction C which is inclined with respect to the direction A of the blade 37*a*. When the supporting face 40 of the movable guide member 35 is placed upon the supporting face 31 of the aforementioned stationary guide member 30, as shown in FIG. 16, the two guide protrusions 32 of the stationary guide member 30 are inserted into the two guide holes 41. Holding heads 32*a* are fixed on the guide protrusions 32 which were inserted into those guide holes 41.

As shown in FIG. 13, there are accommodated in the aforementioned motor barrel 4 the motor 17 and a rotary member 43 which is associated with the output shaft 17*a* of the motor 17 through a jaw shaft 42. On that rotary member 43, there is fixed an eccentric shaft 44 which protrudes into the accommodating barrel 30*a* of the guide member 30. As shown in FIG. 14, an arm 45 has its central portion supported rotatably by a pivot pin 46 within that accommodating barrel 30*a*. With an engagement recess 45*a* at the lower end of that arm 45, there is engaged an engagement member 44*a* which is fixed on the aforementioned eccentric shaft 44. Moreover, an engagement protrusion 45*b* at the upper end of the arm 45 is engaged with an engagement recess 39*a* which is formed in the lower end of the leg 39 of the aforementioned movable guide member 35.

Incidentally, the aforementioned motor 17, jaw shaft 42, rotary member 43 and arm 45 constitute together the drive mechanism.

Now, in this second embodiment, when the switch 26 is turned on to turn the motor 17, the rotary member 43 is rotated through the jaw shaft 42 to rock its eccentric shaft 44. By these rocking motions, moreover, the arm 45 is reciprocally swung at a predetermined angle in the transverse directions on the pivot pin 46. By the regulations of the two guide protrusions 32 of the stationary guide member 30 and the two guide holes 41 of the movable guide member 35, still moreover, this movable guide member 35 placed on the supporting face 31 of the stationary guide member 30 is reciprocated transversely and back and forth. By these reciprocating motions, the spare blade cartridge 37 is similarly reciprocated.

Figure 18:
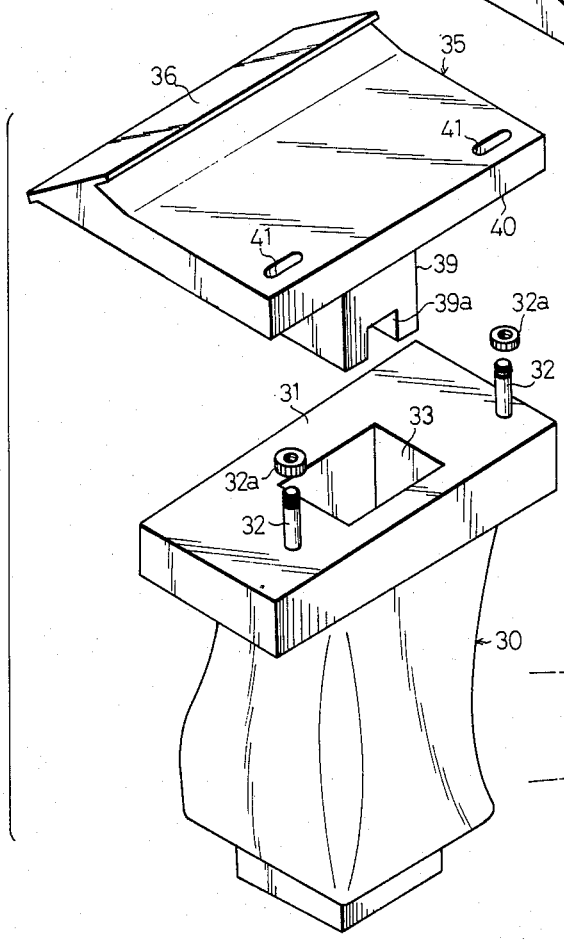
In FIGS. 18 to 20 showing a third embodiment of the present invention.
Figure 19:
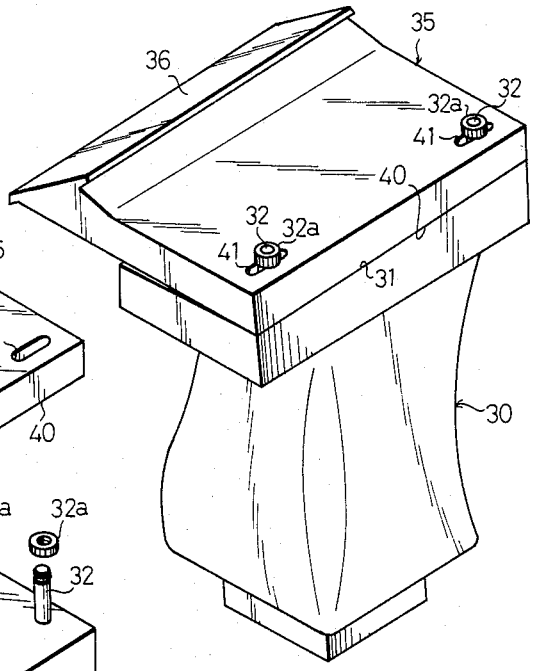
Figure 20:
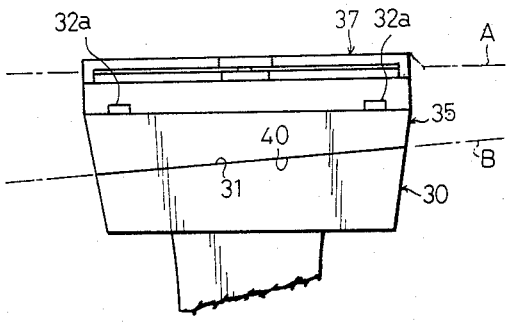

A third embodiment according to the present invention, as shown in FIGS. 18 to 20, is constructed such that the blade 37*a* of the spare blade cartridge 37 can be reciprocated transversely and vertically. The guide holes 41 of the movable guide member 35 are formed to extend in the direction parallel to the longitudinal direction (which should be referred to FIG. 17) of the blade 37*a* of the spare blade cartridge 37. Moreover, the supporting face 31 of the stationary guide member 30 and the supporting face 40 of the movable guide member 35 are sloped, as indicated by letter B in FIG. 20, with respect to the horizontal plane A which extends in the longitudinal direction of the blade 37*a* of the spare blade cartridge 37.

On the other hand, if the guide holes 41 of the movable guide member 35 of this third embodiment are formed like the foregoing second embodiment to incline with respect to the longitudinal direction of the blade 37*a* of the spare blade cartridge 37, this blade 37*a* can be reciprocated not only transversely and vertically, as indicated by the letter B, but also back and forth.

In the second and third embodiments thus far described, the stationary guide member 30 is formed with the protrusions 32 whereas the movable guide member 35 is formed with the guide holes 41. On the contrary, however, the stationary guide member 30 may be formed with guide holes whereas the movable guide member 35 may be formed with guide protrusions. Moreover, the aforementioned arm 45 may be dispensed with, and the engagement member 44*a* of the eccentric shaft 44 may be engaged directly with the engagement recess 39*a* of the movable guide member 35.

Next, a fourth embodiment of the present invention will be described in the following with reference to FIGS. 21 to 26. A holder 71 is formed at its upper end with a cartridge mounting portion 72 which in turn is formed in its top face with a guide groove 73 having its right and upper faces opened, as shown in FIGS. 22 to 26. The guide groove 73 is extended transversely and is so slightly sloped that its closed side may be positioned in a lower left side.

In the aforementioned guide groove 73, there is slidably fitted a lower end portion of a guide rail 74 which is formed with a rail portion 76 at its upper end. In the guide groove 73, there is sandwiched between the inner end face of the guide groove 73 and the guide rail 74 a spring 75 which biases the guide rail 74 rightward at all times. On the aforementioned rail portion 76, there is mounted in a changeable manner a spare blade cartridge 78 the blade 77 of which has its edge extending transversely. Incidentally, the guide rail 74 is prevented from coming out of the guide groove 73 by the fitting engagement between grooves 74*a* formed in the guide rail 74 and ridges 73*a* formed on the upper edge of the guide groove 73.

Figure 21:
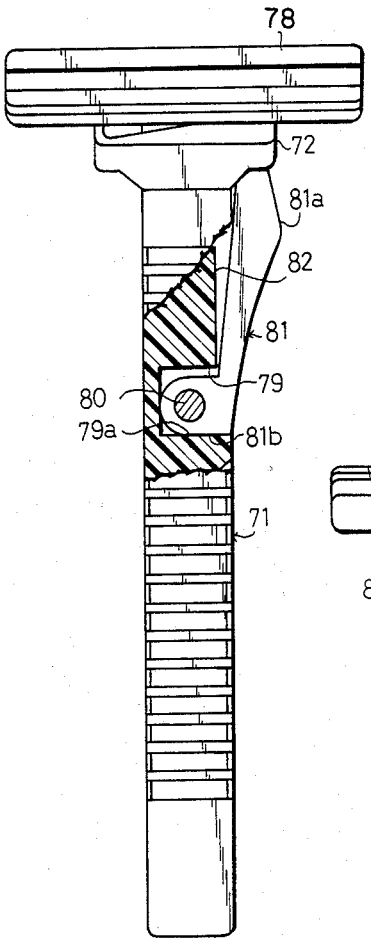
In FIGS. 21 to 26 showing a fourth embodiment of the present invention.
Figure 22:
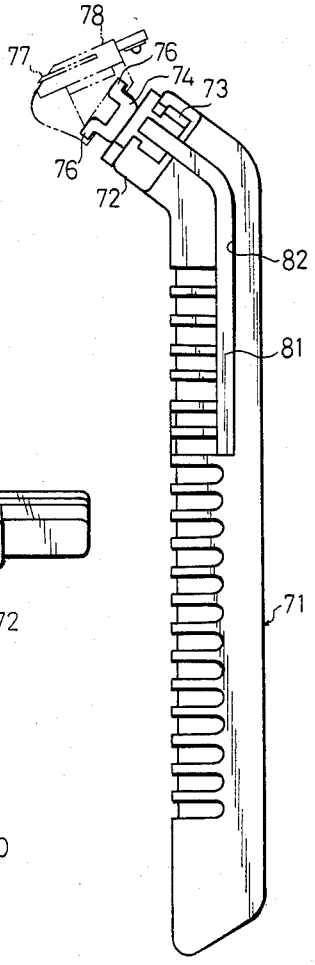
Figure 23:
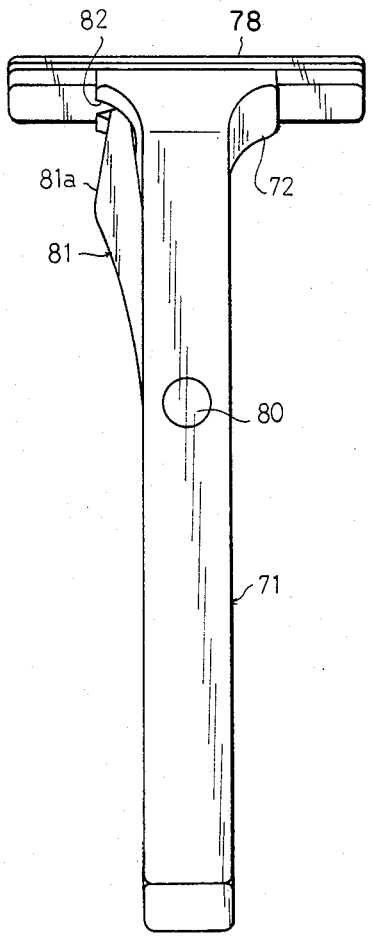
Figure 24:
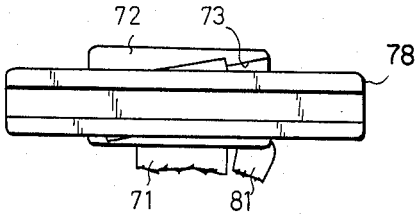
Figure 25:
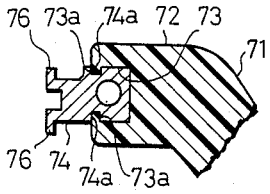
Figure 26:
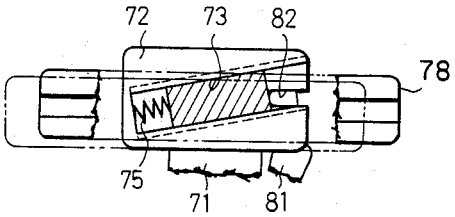

As shown in FIG. 21, the aforementioned holder 71 is formed in the vicinity of its upper end with a hinge recess 79 which is opened to the right. In this hinge recess 79, there is hinged by means of hinge pin 80 the lower end of a push lever 81 which acts as a manually operating member. From the hinge recess 79 to the aforementioned guide groove 73, there is formed a positioning groove 82, through which the aforementioned push lever 81 extends to have its leading end abutting against the right side face of the aforementioned guide rail 74. The push lever 81 is formed with a bulging push portion 81*a* on its right side edge. Incidentally, the biasing force of the aforementioned spring 75 is exerted as a rightward force upon the push lever 81 through the guide rail 74, too. The right end position of the guide rail 74 is regulated by the engagement between the lower end face 81*b* of the push lever 81 and the lower face 79*a* of the hinge recess 79.

As a result, if the push portion 81*a* of the push lever 81 is pushed during the shaving action against the biasing force of the spring 75, the guide rail 74 is moved to the left and slightly lowered along the guide groove 73 by the push lever 81. If the push lever 81 is released from the pushing force, on the contrary, the guide rail 74 is moved in the direction opposite to the above one by the biasing force of the spring 75. As a result, the hair is subjected to not only the vertical cutting but also the pulled cutting so that it can be effectively cut.

Figure 27:
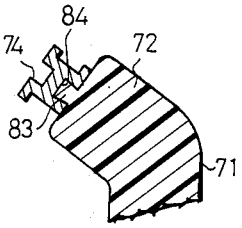
FIGS. 27 to 29 are a sectional view and partially broken top plan views showing other examples of the fourth embodiment of the present invention, respectively.

Here, the razor according to this fourth embodiment can also be modified, as follows:

(I) The bulging and recessed relationship between the cartridge mounting portion 72 and the guide rail 74 is reversed. In other words, as shown in FIG. 27, the cartridge mounting portion 72 is formed with a ridge 83 whereas the guide rail 74 is formed with a guide groove 84 in which the ridge 83 is to be fitted.

Figure 28:
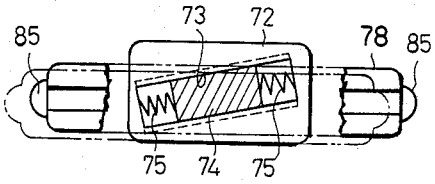

(II) As shown in FIG. 28, the guide rail 74 is formed at both its ends with grip portions 85 for moving the guide rail 74 to the right or left. In this case, therefore, the push lever 81 can be dispensed with, and it is necessary to close both the right and left sides of the guide groove 73 and to dispose a pair of springs 75 at both the right and left sides of the guide rail 74.

Figure 29:
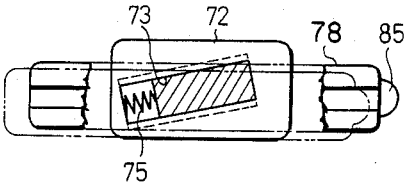

(III) As shown in FIG. 29, the guide rail 74 is formed with the grip portion 85 at its one end.

Figure 30:
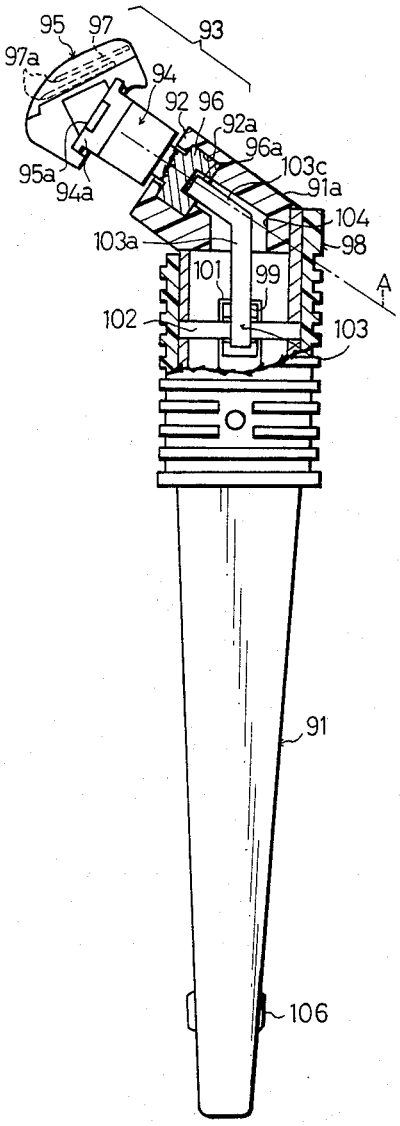
In FIGS. 30 to 34 showing a fifth embodiment of the present invention.
Figure 34:
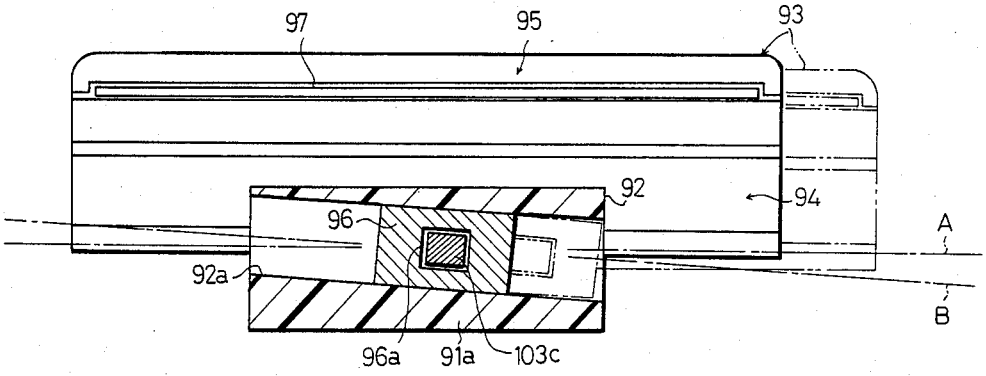

Next, a fifth embodiment of the present invention will be described in the following with reference to FIGS. 30 to 34. As shown in FIG. 30, a holder 91 is formed with a rail portion 92 on the front face of its head 91*a*. This rail portion 92 has its inside guide groove 92*a* extending in the directions B which are inclined with respect to the plane A extending transversely, as shown in FIG. 34.

A head 93 acting as the blade mounting porition is constructed of a supporting member 94 and a spare blade cartridge 95 which is removably supported through its fitting groove 95*a* on a guide rail 94*a* formed in the front end portion of the supporting member 94. In the guide groove 92*a* of the aforementioned rail portion 92, there is fitted a guide block 96 which is formed at the back of the supporting member 94. Moreover, the head 93 is so supported in its entirety on the rail portion 92 that it can reciprocate in the directions B which are inclined with respect to the plane A extending in the longitudinal directions of the edge 97*a* of a blade 97 of the spare blade cartridge 95.

Figure 31:
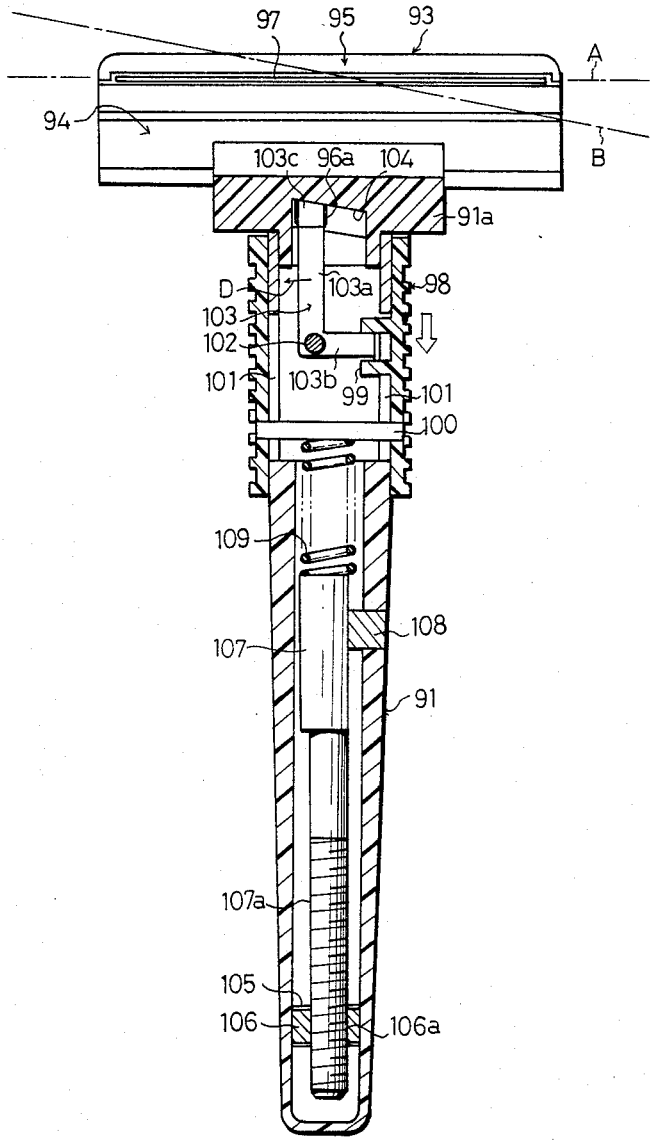

A cylindrical grip portion 98 is fitted on the outer periphery of the upper portion of the holder 91 such that it can move up and down along the holder 91. As shown in FIG. 31, a connecting groove 99 formed in the grip portion 98 and a pressure receiving portion 100 positioned below the former are protruded into the holder 91 through long holes 101 formed at both the right and left side of the upper portion of the holder 91. In the upper portion of the holder 91, moreover, there is fixed a hinge pin 102 which extends back and forth in a manner parallel to the connecting groove 99 of the grip portion 98. A coacting lever 103 is hinged in a rocking manner to that hinge pin 102. As better seen from FIG. 33, the coacting lever 103 is composed of an upright portion 103*a* borne on the hinge pin 102 at its lower end, a horizontal portion 103*b* protruding from the lower end of the upright portion 103*a*, and a slanting portion 103*c* protruding from the upper end of the upright portion 103*a*. The end of said horizontal portion 103*b* is fitted in the connecting groove 99 of the grip portion 98. A communication hole 104 is formed in the head 91*a* of the holder 91 in a manner to communicate with the guide groove 92*a* of the aforementioned rail portion 92. The slanting portion 103*c* of the coacting lever 103 protruding through that communication hole 104 into the guide groove 92*a* is fitted in a connecting recess 96*a* formed in the guide block 96 of the aforementioned supporting member 94.

Figure 32:
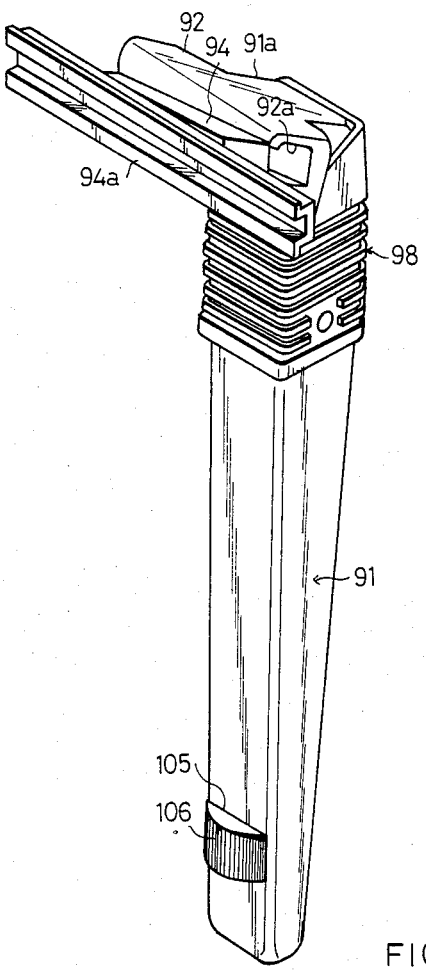
Figure 33:
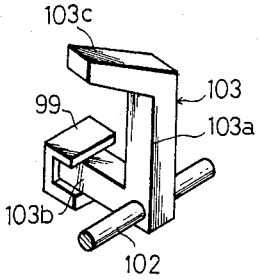

As shown in FIGS. 31 and 32, an adjusting knob 106 is so fitted in the lower end portion of the inside of the holder 91 that it is exposed back and forth of the holder 91 through a through hole 105. On the internally threaded portion 106*a* of that adjusting knob 106, there is screwed an externally threaded portion 107*a* of a push lever 107 which is inserted into the lower portion of the inside of the holder 91. The push lever 107 is so retained by a stopper 108 that it is unrotatable with respect to the holder 91, but can be moved up and down through the two threaded portions 106*a* and 107*a* by turning the adjusting knob 106. A spring 109 is sandwiched between the upper end of the push lever 107 and the pressure receiving portion 100 of the aforementioned grip portion 98. The grip portion 98 is so biased by the spring 109 as to move upward at all times. By this biasing force, the coacting lever 103 is tilted in the direction of arrow D, as viewed in FIG. 31, so that the guide block 96 of the head 93 is moved to the position which is indicated by solid lines in FIG. 34.

Now, during the shaving action, the grip portion 98 is held between the thumb and forefinger of the user's hand gripping the holder 91 and is moved down against the biasing force of the spring 109. Then, the coacting lever 103 is tilted in the direction opposite to the arrow D of FIG. 31 so that the guide block 96 is moved along the guide groove 92*a*, as shown by phantom lines in FIG. 34. As a result of this movement, the blade 97 of the head 93 is made to run obliquely in the aforementioned inclined direction B. In the course of the shaving action, on the other hand, the grip portion 98 is released from the holding force of the thumb and forefinger. Then, the biasing force of the spring 109, the grip portion 98 is moved upward to restore its initial position so that the coacting lever 103 is tilted in the direction of the arrow D of FIG. 31. Moreover, the blade 97 of the head 93 is returned to the position shown by the solid lines in FIG. 34 in accordance with the movement of the guide block 96. If the grip portion 98 is operated during the shaving action in the manner described above, the blade 97 of the head 93 can be reciprocated at will so that the hair can be not only pressed but also pulled to be cut without fail.

If the adjusting knob 106 is turned to move the push lever 107 up and down, on the other hand, the biasing force of the spring 109 to be exerted upon the grip portion 98 can be changed to adjust its downward operating force or returning force.

Incidentally, the fifth embodiment thus far described can be practised in the following modes:

(I) In the fifth embodiment, the grip portion 98 is formed into such a cylindrical shape as to enclose the holder 91. To one side face of the holder 91, however, a grip portion may be attached in a vertically movable manner so that it may be operated by the thumb of the hand gripping the holder 91.

(II) In the fifth embodiment, the upward movement of the grip portion 98 is undergone by means of the spring 109. However, this spring 109 may be dispensed with, and the vertical movement of the grip portion 98 may be effected exclusively by the forced action of the finger of the hand gripping the holder 91.

(III) The spring 109 may be connected to the coacting lever 103 or the guide block 96.

(IV) The coacting lever 103 may be replaced by a cam.

(V) The bulging and recessed relationship between the rail portion 92 and the supporting member 94 of the head 93 may be reversed.

(VI) In the head fixed in the holder 91, only the blade mounting portion supporting the blade may be reciprocated.

Figure 36:
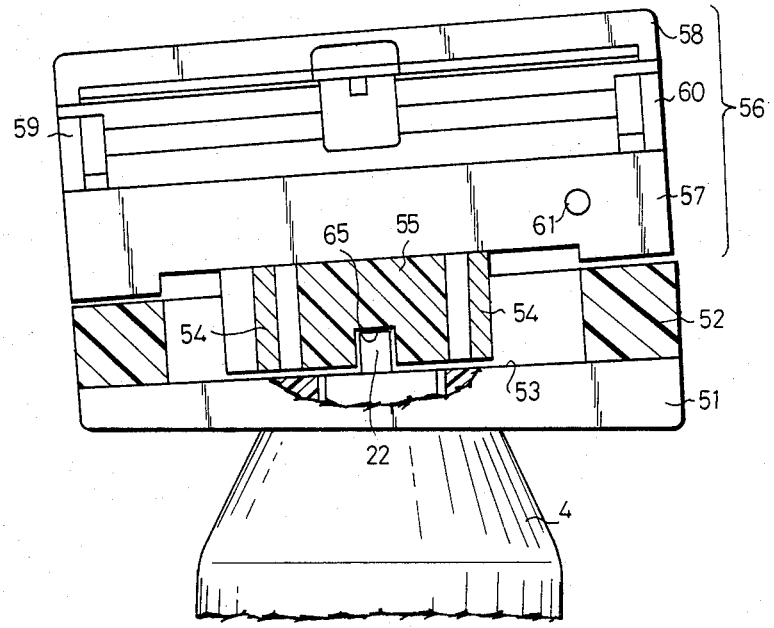
FIG. 36 is a partially enlarged sectional view showing the back of the razor of FIG. 35.
Figure 37:
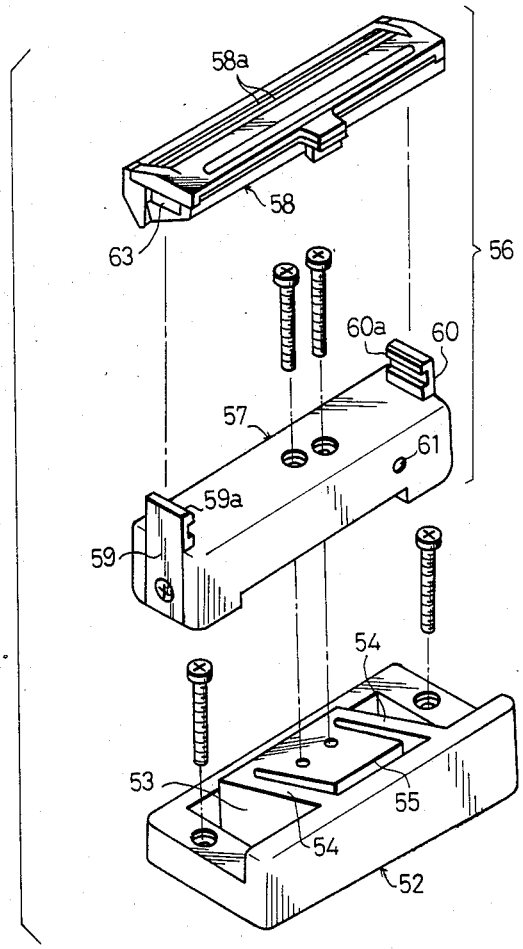
FIG. 37 is a partially exploded perspective view showing a supporting member for the upper end portion of a holder, a head mounting bed, and a spare blade cartridge.

At last, other examples of the head supporting structure for bringing the head obliquely up and down will be described in the following with reference to FIGS. 35 to 40. A supporting member 52 is fixed through a platform 51 on the upper end of the motor barrel 4. The abutting faces of these two members 52 and 51 have their portions sloped in the transverse directions, as shown in FIG. 36. Turning to FIG. 37, a pair of leaf springs 54 having transverse elasticities are disposed to protrude from both the right and left sides of the rear face of a hole 53 in that supporting member 52 obliquely forward in parallel with each other, and a supporting bed 55 is interposed between the two leaf springs 54 and connected integrally with the leading end portions of the same.

Figure 35:
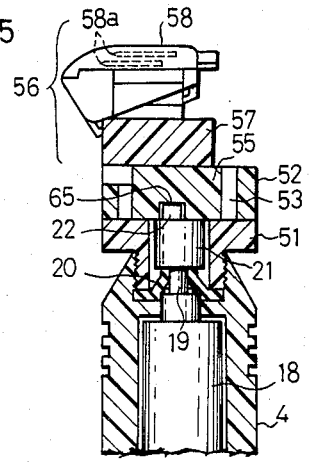
FIG. 35 is a sectional view showing another example of a head supporting structure.
Figure 38:
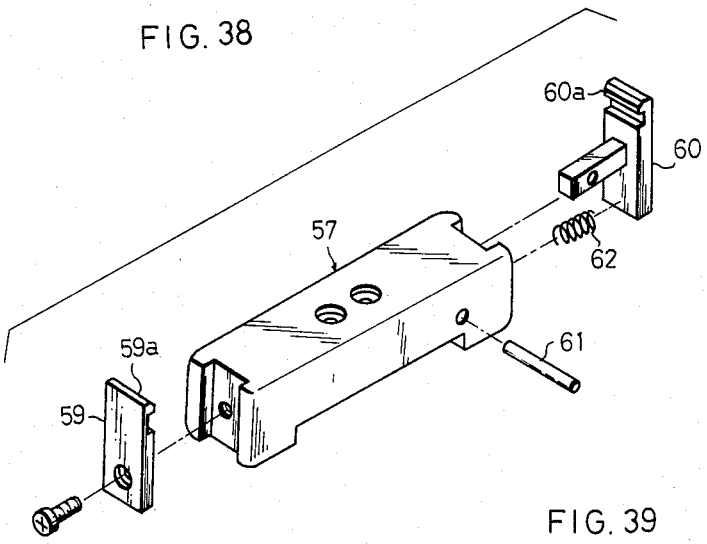
FIG. 38 is an exploded perspective view showing the mounting bed.
Figure 39:
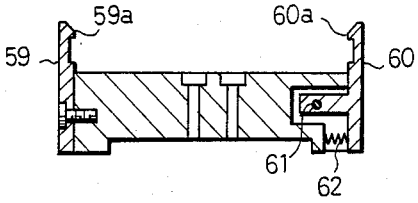
FIG. 39 is a sectional view showing the assembly of the mounting bed.
Figure 40:
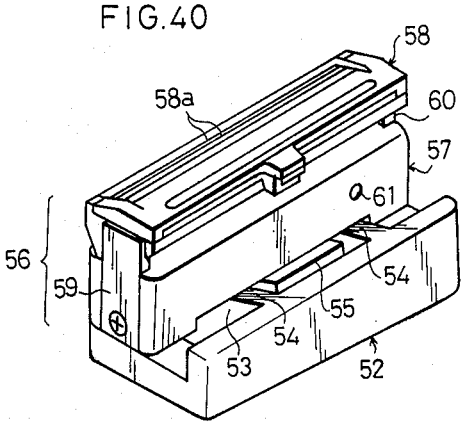
FIG. 40 is a perspective view showing the assembly of FIG. 37.

As better seen from FIG. 35, a head 57 acting as the blade mounting portion is constructed of a mounting bed 57 placed on the supporting bed 55 and a spare blade cartridge 58 clamped on the mounting bed 57. As shown in FIGS. 37 to 39, a clamping arm 59 at a stationary side is fixed at one side of the mounting bed 57, and a clamping arm 60 at a movable side is so hinged to the other side of the mounting bed 57 as to turn sideway by means of a hinge pin 61 such that it is always biased by the action of a spring 62 to the position where it faces the clamping arm 59 at the stationary side. The two clamping arms 59 and 60 are formed on their opposed faces, respectively, with engagement lands 59*a* and 60*a*, which are to be engaged with engagement grooves 63 formed in both the right and left side faces of the spare blade cartridge 58 when this spare blade cartridge 58 is fitted between the two clamping arms 59 and 60 against the biasing force of the clamping arm 60 at the movable side, as shown in FIG. 40. If the movable side clamping arm 60 is inclined sideway from its engaged state against the biasing force of the spring 63, moreover, the engagement land 60*a* of the movable side clamping arm 60 is brought out of engagement with the engagement groove 63 of the spare blade cartridge 58 so that this cartridge 58 can be removed from the mounting bed 57.

Turning to FIG. 35, the rotary shaft 19 of the reduction gear head 18 is produced upward through the water-proofing shield 20 into the aforementioned motor barrel 4. In the platform 51 of the motor barrel 4, there is fixed to that rotary shaft 19 the rotary member 21 having the eccentric shaft 22, which is fitted in an engagement recess 65 formed in the lower face of the aforementioned supporting bed 55.

Now, when the spare blade cartridge 58 is pressed against the skin surface and the motor is energized, the rotary member 21 is turned through the speed reduced rotary shaft 19 so that its eccentric shaft 22 is rocked. By these rocking motions, moreover, the supporting bed 55 is reciprocated transversely and obliquely up and down against the biasing forces of the leaf springs 54. By these reciprocating motions, the spare blade cartridge 58 is likewise reciprocated together with its blade 58*a* through the mounting bed 57.

Since it is apparent that the present invention can be embodied in widely different modes without departing from the scope and range thereof, it should not be limited to the specified embodiments except that it is defined by the appended claims.

What is claimed is:

1. A T-shaped razor comprising:

a holder adapted to be held by a user for shaving, said holder having an upper end portion, and front, rear and two side portions, said front portion being adapted to face parallel to a skin surface to be shaved when the holder is held by the user for shaving;

means for supporting a blade cartridge slidably connected to the upper end portion of the holder, said supporting means being at least obliquely and rectilinearly slidabe along a path extending from the front side portion to the rear side portion of the holder so that the supporting means is gradually moved between the front and rear portions as the supporting means moves laterally between the two side portions;

a blade cartridge connected to the supporting means and having at least one blade with a blade edge for shaving, said blade cartridge being inclined relative to the supporting means so that the blade edge extends perpendicularly to the longitudinal direction of the holder and parallel to the front portion of the holder, said blade edge, when the blade cartridge is moved along the path while the blade edge abuts against the skin surface to be shaved, moving obliquely relative to the longitudinal direction of the blade edge and substantially parallel to the skin surface to be shaved thereby to cut hairs with an action that also pulls the hairs; and means for reciprocating the supporting means along the path, said reciprocating means being installed in the holder so that when the reciprocating means is actuated, the blade cartridge reciprocates together with the supporting means.

2. A T-shaped razor according to claim 1, in which length of said path along which the supporting means reciprocates is at least about 1 mm.

3. A T-shaped razor according to claim 2, in which said supporting means comprises at least two guide protrusions connected to the upper end portion of the holder, and a cartridge holding device having a holding portion at an upper end thereof for firmly and exchangeably receiving the blade cartridge and at least two guide holes for connecting the cartridge holding device to the holder and extending obliquely relative to the front portion of the holder when the cartridge holding device is connected to the holder, said guide protrusions being inserted into the guide holes thereby to connect the cartridge holding device to the holder so that when the reciprocating means is actuated, the cartridge holding device is obliquely moved relative to the holder.

4. A T-shaped razor according to claim 3, in which said cartridge holding device includes an engagement recess at a lower portion thereof, and said reciprocating means includes a motor having a rotatory output, reduction gear means connected to the motor, a rotary member connected to the reduction gear means and having an eccentric shaft, and an arm engaging the eccentric shaft at a lower end and the engagement recess at an upper end thereof so that when the motor is actuated, the eccentric shaft rotates to thereby reciprocate the cartridge holder along the guide holes.

5. A T-shaped razor according to claim 2, in which said supporting means comprises a mounting portion connected to the upper end portion of the holder, said mounting portion having a guide groove constituting the path of the supporting means, and a cartridge holding device slidably situated in said guide groove of the mounting portion, said cartridge holding device having a holding portion at an upper end thereof for firmly and exchangeably receiving the blade cartridge, the blade edge of the blade cartridge, when the blade cartridge is firmly attached to the cartridge holding device, being oriented perpendicularly to the longitudinal direction of the holder and parallel to the front portion of the holder.

6. A T-shaped razor according to claim 5, in which said mounting portion of the support means is oriented relative to the holder so that the cartridge holding device faces perpendicularly to the skin surface to be shaved, whereby the blade edge abutting against said skin surface can be reciprocated substantially parallel to said skin surface.

7. A T-shaped razor according to claim 6, in which said mounting portion of the supporting means further comprises a rail portion inside the guide groove, said cartridge holding device engaging said rail portion.

8. A T-shaped razor according to claim 6, in which said cartridge holding device includes an engagement recess at a lower portion thereof situated inside the guide groove, and said reciprocating means includes a motor having a rotating output, reduction gear means connected to the motor, and a rotary member connected to the reduction gear means, said rotary member having an eccentric shaft engaging said engagement recess so that when the motor is actuated, the eccentric shaft rotates to thereby reciprocate the cartridge holding device along the path.

9. A T-shaped razor according to claim 6, in which said supporting means further comprises at least one spring situated in the guide groove thereof to urge the cartridge holder in one direction along the guide groove.

10. A T-shaped razor according to claim 9, in which said reciprocating means comprises a lever having upper and lower end portions, and a shaft connected to the lever for pivotally supporting the lower end portion of the lever, the upper end portion of the lever being connected to the cartridge holding device so that when the lever is pushed, the cartridge holding device is moved along the guide groove.

11. A T-shaped razor according to claim 9, in which said reciprocating means comprises a lever having upper and lower end portions, a shaft connected to the lever between the upper and lower end portions, said shaft being pivotally connected to the holder for supporting the lever for rotation about the holder, a grip portion slidably situated over the holer, and a spring for urging the grip portion upwardly, said upper end portion of the lever engaging the cartridge holder and the lower end portion of the lever engaging the grip portion so that when the grip portion is moved along the holder, the cartridge holder is moved along the guide groove.

* * * * *